United States Patent [19]

Vollstedt

[11] 3,952,695

[45] Apr. 27, 1976

[54] SLOTTED TUBULAR FLAGPOLE

[76] Inventor: Otto A. Vollstedt, 5415 Palestine Ave., NW., Albany, Oreg. 97321

[22] Filed: Oct. 30, 1974

[21] Appl. No.: 519,285

[52] U.S. Cl. ..... 116/173; 138/172

[51] Int. Cl.[2] ..... G09F 17/00

[58] Field of Search ..... 116/173, 174; 138/166, 138/172; 52/720, 731

[56] References Cited

UNITED STATES PATENTS

| | | | |
|---|---|---|---|
| 132,475 | 10/1872 | Linville | 138/172 X |
| 1,610,663 | 12/1926 | Diago | 116/173 |
| 2,167,579 | 7/1939 | Gardella | 116/173 |
| 2,325,616 | 8/1943 | Landweber | 138/166 X |
| 3,417,732 | 12/1968 | Platt, Jr. | 116/173 |

*Primary Examiner*—Richard C. Queisser
*Assistant Examiner*—Daniel M. Yasich
*Attorney, Agent, or Firm*—Clarence A. O'Brien; Harvey B. Jacobson

[57] ABSTRACT

A tubular staff is provided and includes a longitudinal slot extending therealong throughout at least a major portion of the length of the staff. A plurality of bracing structures spaced along the slotted portion of the staff internally thereof rigidly brace adjacent portions of the staff disposed on opposite sides of the slot relative to remote peripheral portions of the staff. Aligned first and second pulleys are journaled in opposite end portions of the staff for rotation about transverse axes and an endless tension member is trained over and frictionally engaged with the pulleys and includes one reach thereof extending between the pulleys spaced immediately inwardly of and extending along the slot. Follower structure is attached to the aforementioned reach of the tension member and projects through and is slidingly engaged in the slot. The follower structure includes anchor portions thereof disposed exteriorly of and spaced along the length of the staff to which the upper and lower inner corner portions of a flag may be attached and the lower pulley within the staff includes structure whereby that pulley may have rotational torque applied thereto.

4 Claims, 6 Drawing Figures

SLOTTED TUBULAR FLAGPOLE

BACKGROUND OF THE INVENTION

Heretofore various forms of flagstaffs and flagpoles have been designed from aesthetic standpoints and also from the standpoints of serviceability and ease of use. Further, there has also been attempts to design flagstaffs and flagpoles which are substantially protected from vandalism.

Examples of previously patented flagpoles of this type and of other structures which include features similar to those incorporated in the present invention may be found in U.S. Pat. Nos. 132,457, 940,173, 1,610,663, 1,645,645 and 3.418,967.

SUMMARY OF THE INVENTION

The flagpole of the instant invention is constructed in a manner whereby vandalism with regard to the halyard thereof or a flag being flown therefrom is greatly discouraged. The flagpole includes only a shaft end portion at its lower end with which a crank handle may be removably engaged and a longitudinal slot which may be tampered with, the halyard portion of the flagpole and support structure therefor being housed entirely within the tubular flagpole in a manner at least substantially protected from vandalism.

In addition, the halyard of the flagpole, by not being disposed exteriorly thereof as is conventional, is not subject to flapping against the exterior surfaces of the pole during windy weather and the halyard is substantially fully protected from the elements and therefore has a longer life expectancy.

The main object of this invention is to provide a flagpole having improved aesthetic features.

Another object of this invention is to provide a flagpole supporting the associated halyard in a substantially fully enclosed position to hereby increase the life expectancy of the halyard.

Yet another object of this invention, in accordance with the immediately preceding object, is to provide a flagpole wherein its flag raising features are substantially fully protected against vandalism.

A final object of this invention to be specifically enumerated herein is to provide a flagpole which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
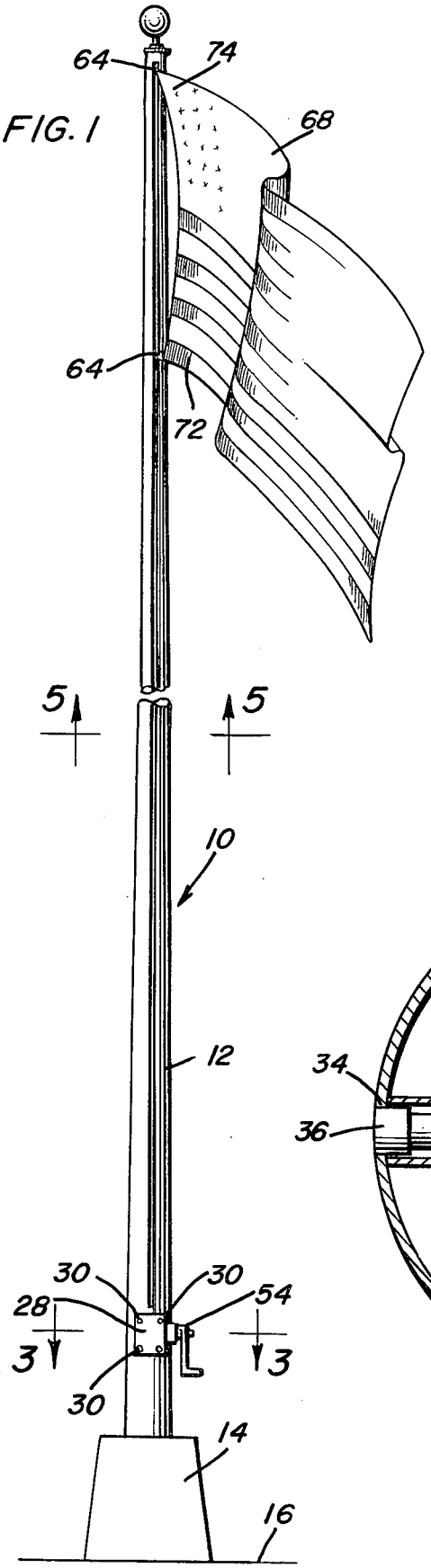
FIG. 1 is an elevational view of the flagpole of the instant invention in operation flying a flag from the upper end thereof.
Figure 3:
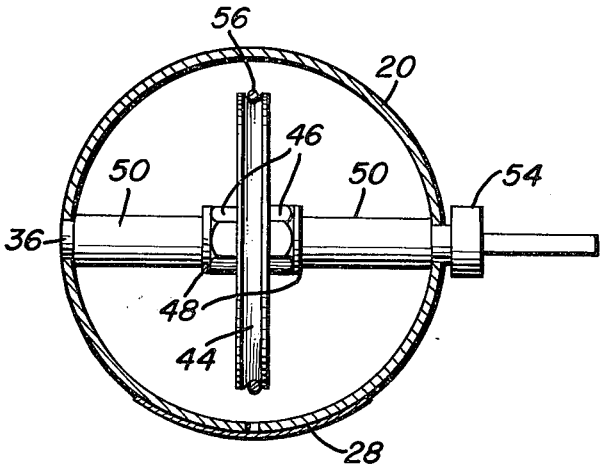
FIG. 3 is an enlarged horizontal sectional view taken substantially upon the plane indicated by the section line 3—3 of FIG. 1.
Figure 4:
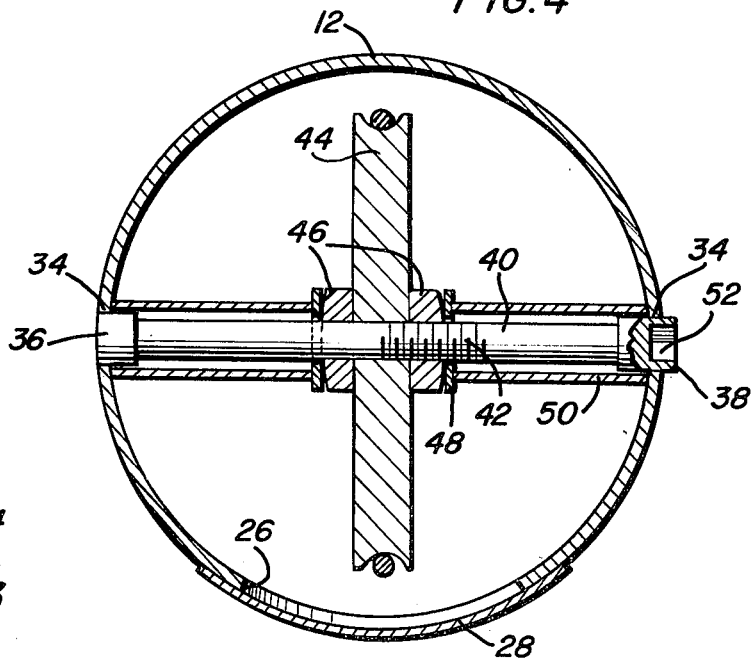
FIG. 4 is a further enlarged sectional view similar to FIG. 3 but illustrating the lower pulley and lower pulley supporting structure in horizontal cross section.
Figure 2:
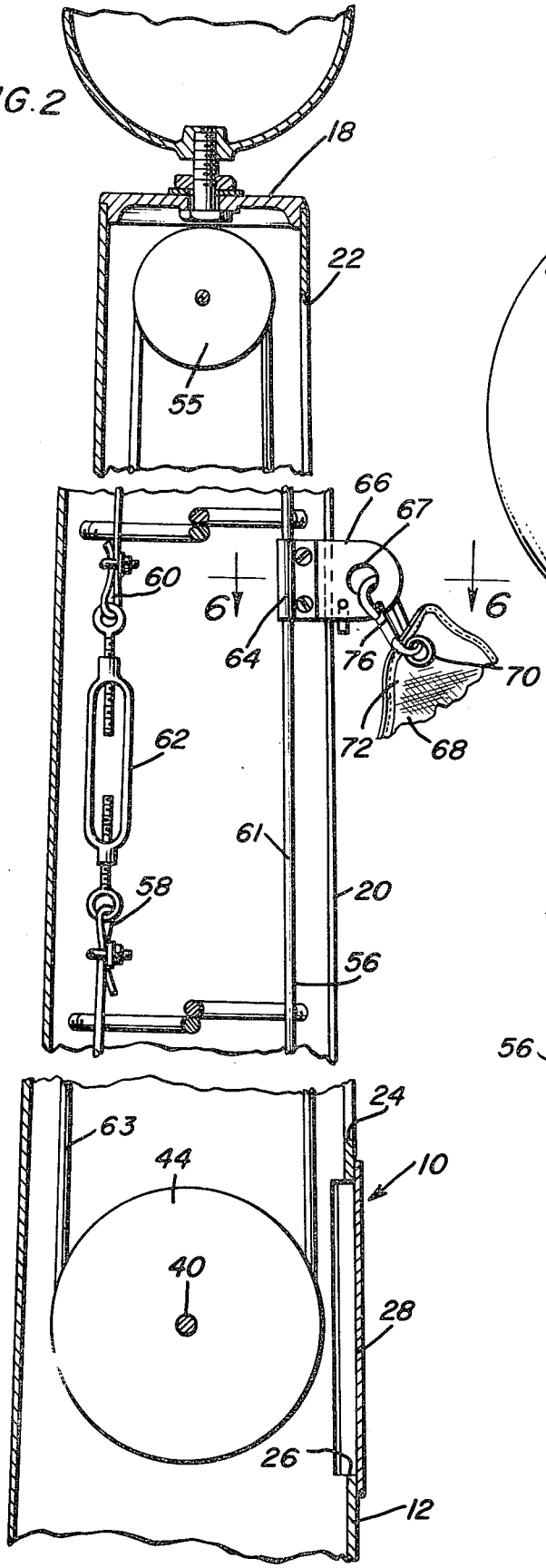
FIG. 2 is a fragmentary enlarged longitudinal vertical sectional view of the flagpole illustrated in FIG. 1 and taken substantially upon a plane passing through and along the longitudinal slot of the pole.

Referring now more specifically to the drawings, the numeral 10 generally designates the tubular flagpole assembly of the instant invention. The assembly 10 consists of an upwardly tapering vertical tubular member 12 having its lower end suitably anchored to a base 14 disposed on and suitably anchored to a support surface 16.

The tubular member 12 is closed at its upper end by means of a cap structure 18 and is provided with a longitudinal slot 20 whose opposite ends terminate spaced distances from the upper and lower ends of the tubular member 12 as at 22 and 24. Also, the lower end portion of the tubular member 12 has a window opening 26 formed therein a spaced distance below the lower end of the slot 20 and closed by means of a removable door 28 which may be semi-permanently secured in the closed position in any suitable manner such as by fasteners 30 in order to discourage unauthorized removal of the closure or door 28.

The lower end portion of the tubular member 12 is provided with diametrically opposite and aligned horizontal radial bores 34 and diametrically enlarged opposite end portions 36 and 38 of an operating shaft 40 having a threaded center portion 42 are journaled in the bores 34.

A peripherally grooved pulley wheel 44 is disposed on the center portion 42 of the operating shaft 40 and clamped in position thereon between a pair of threaded nuts 46 threaded on the center portion 42. Also, a pair of washers 48 are disposed on the operating shaft 40 and oppose the remote sides of the nuts 46. Further, spacing sleeves 50 of approximately the same inside diameter as the bores 34 are disposed on the opposite end portions of the operating shaft 40 with their remote ends abutted against the inner surfaces of the tubular member 12 disposed about the bores 34 and their adjacent ends opposing the washers 48. Still further, the end portion 38 of the operating shaft 40 includes an endwise outwardly opening non-circular recess 52 in which a similar projection carried by a crank 54 is removably received with the crank 54 drivingly connected to the shaft 40.

An upper grooved pulley wheel 55 aligned with the pulley wheel 44 is journaled within the upper end of the tubular member in substantially the same manner as the pulley wheel 44 is journaled in the lower end of the tubular member 12.

An elongated flexible tension member 56 is trained about the pulley wheels 44 and 55 and includes a pair of opposite end portions 58 and 60 disposed in one reach 63 of the tension member 56 joined by means of an adjustable length turnbuckle 62 whereby the tension of the tension member 56 trained about the pulley wheels 44 and 55 may be adjusted whenever desired.

The other reach 61 of the tension member 56 has a pair of follower assemblies or members 64 clamped thereon against movement along the tension member 56 and the follower members 64 include blade portions 66 which project through and are slidably received in the slot 20 for movement therealong, the outer ends of the blade portions 66 being apertured as at 67 to define anchor points.

A flag 68 is provided and includes grommets 70 secured through its inner corner portions 72 and 74 and a spring clip 76 is engaged with each grommet 70 and releasably engaged with the corresponding anchor point defined by the apertured outer end of the adjacent follower member blade portion 64. Accordingly, the flag 68 is supported from the follower members 64 for movement along the tubular member 12 as the reach of the tension member 56 adjacent the slot 20 is moved therealong.

In order to strengthen the tubular member 12 which is slotted throughout a substantial portion of its length, pairs of crossed bracing members 78 and 80 are provided at points spaced along the slotted portion of the tubular member 12. The bracing members 78 and 80 each comprise rod members including threaded opposite end portions 82 and the threaded opposite ends of the bracing members 78 and 80 are threadedly engaged in threaded diametrically aligned radial bores 84 formed in the tubular member 12. Prior to completion of the installation of the bracing members 78 and 80, one end of each bracing member is pointed as at 86 and the other end thereof is provided with a screwdriver kerf 88. Of course, the conically pointed ends 86 of the bracing members facilitate installation of the bracing members in the tubular member and the slotted ends 88 enable a screwdriver or similar tool to be engaged with the bracing members in order that they may be threaded into position. After each bracing member 78 and 80 is installed, the pointed tip 86 on one end thereof may be ground off or otherwise removed and the outwardly projecting slotted opposite end of the bracing member may also be ground off or otherwise removed so that the ends of the tension members or bracing members 78 and 80 may be flush with the adjacent external surfaces of the tubular member 12.

Figure 5:
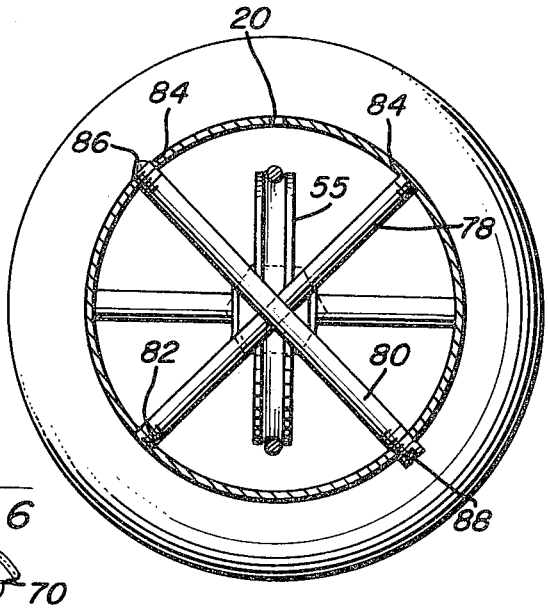
FIG. 5 is a horizontal sectional view taken substantially upon the plane indicated by the section line 5—5 of FIG. 1.
Figure 6:
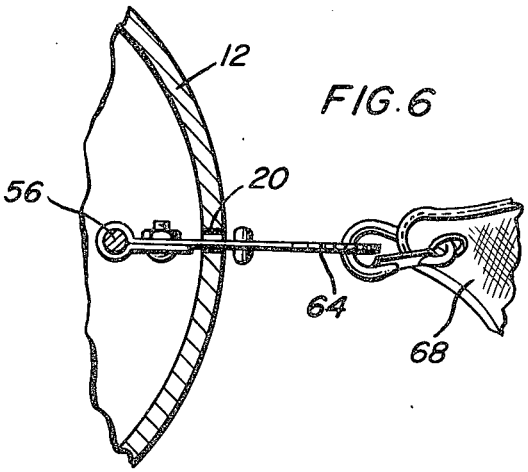
FIG. 6 is an enlarged fragmentary horizontal sectional view taken substantially upon the plane indicated by the section line 6—6 of FIG. 2.

It may be noted from FIG. 5 of the drawings that one pair of corresponding ends of each pair of bracing members 78 and 80 are threadedly engaged in bores 84 formed in those portions of the tubular member 12 disposed on opposite sides of the slot 20 and therefore that the bracing members 78 and 80 do not interfere with the vertical reaches of the tension member 56 or the turnbuckle 62 during lengthwise advancement of either tension member reach longitudinally of the tubular member 12.

In operation, the crank 54 is removably engaged with the operating shaft 40 in the manner hereinbefore set forth and turned to raise or lower the flag 68. Of course, whenever the flag 68 is being flown the follower members 64 will be disposed considerably above ground level. Further, it is proposed that when the flag is lowered and removed from engagement with the follower member 64, the crank 54 will be operated to place the follower members 64 in the raised positions even when the flag 68 is not being flown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A flagpole construction including a tubular staff, said staff being provided with a longitudinal slot extending therealong throughout at least a major portion of the length of said staff, a plurality of bracing structures spaced along the slotted portion of said staff internally thereof and rigidly bracing the wall portions of said staff disposed on opposite sides of said slot relative to remote peripheral portions thereof, generally aligned first and second pulley means journaled in opposite end portions of said staff for rotation about transverse axes, and an endless tension member trained about and frictionally engaged with said pulley means and including one reach thereof extending between said pulley means spaced closely inwardly of and extending along said slot, follower means attached to said one reach for movement therewith and including portions thereof spaced along said one reach and slidingly engaged in and projecting through said slot, and first and second anchor means carried by said follower means, disposed exteriorly of said staff and spaced along the latter for supportive engagement of the upper and lower inner corner portions of a flag therewith, at least one of said pulley means including drive input means adapting that pulley means to have rotational torque applied thereto, each of said bracing structures comprising a pair of crossed rod members generally bisecting the interior of said staff and having their opposite end portions anchored to the wall portions of said staff with which they are aligned, one pair of adjacent ends of each pair of crossed rod members being substantially equally spaced from and disposed on opposite sides of said slot, said one reach of said tension member being generally centered between said adjacent crossed rod member ends.

2. The combination of claim 1 wherein said slot includes closed opposite end portions spaced from the opposite ends of said staff.

3. The combination of claim 1 wherein the opposite ends of said rod members are threadedly engaged with said staff wall portions.

4. The combination of claim 1 wherein said staff includes a base end portion in which one of said pulley means is disposed, said drive input means including a crank removably drivingly engaged with said one pulley means and disposed exteriorly of said staff.

* * * * *